US005843538A

United States Patent [19]

Ehrsam et al.

[11] Patent Number: 5,843,538

[45] Date of Patent: Dec. 1, 1998

[54] METHOD FOR ELECTROLESS NICKEL PLATING OF METAL SUBSTRATES

[75] Inventors: Robert Ehrsam, Shelton, Conn.; John L. Raymond, 222 SunnieHolme Dr., Fairfield, Conn. 06430

[73] Assignee: John L. Raymond, Fairfield, Conn.

[21] Appl. No.: 970,906

[22] Filed: Nov. 14, 1997

Related U.S. Application Data

[63] Continuation of Ser. No. 761,849, Dec. 9, 1996, abandoned.

[51] Int. Cl.[6] ..... B06B 1/70

[52] U.S. Cl. ..... 427/601; 427/307; 427/436; 427/437; 427/443.1; 427/443.2

[58] Field of Search ..... 427/307, 436, 427/437, 443.1, 443.2, 601

[56] References Cited

U.S. PATENT DOCUMENTS

| | | | |
|---|---|---|---|
| 2,266,330 | 12/1941 | Nachtman . | |
| 3,884,149 | 5/1975 | Shores | 101/450 |
| 3,892,635 | 7/1975 | Mallico | 204/15 |
| 3,988,518 | 10/1976 | McGrath | 427/436 |
| 4,204,013 | 5/1980 | Arcilesi et al. | 427/304 |
| 4,257,853 | 3/1981 | Quinton et al. | 204/32 R |
| 4,350,717 | 9/1982 | Aroki et al. | 427/8 |
| 4,554,210 | 11/1985 | Gamblin | 428/667 |
| 4,670,312 | 6/1987 | Ehrsam | 427/438 |
| 4,686,114 | 8/1987 | Halliwell et al. | 427/53.1 |
| 4,904,351 | 2/1990 | Morin | 204/28 |
| 5,028,454 | 7/1991 | Lytle et al. | 427/123 |
| 5,167,680 | 12/1992 | Ting et al. | 427/96 |
| 5,167,992 | 12/1992 | Lin et al. | 427/437 |
| 5,250,105 | 10/1993 | Gomes et al. | 106/1.11 |
| 5,466,360 | 11/1995 | Ehrsam et al. | 205/170 |

OTHER PUBLICATIONS

Richard L. Macary of Enthone, Inc., "Better Plating of Electroless Nickel on Aluminum", Products Finishing, Oct. 1987, pp. 52–63.

*Primary Examiner*—Benjamin Utech
*Attorney, Agent, or Firm*—Ware, Fressola, Van Der Sluys & Adolphson LLP

[57] ABSTRACT

The present invention relates to a method for plating nickel onto metal substrates. The method broadly comprises the steps of passing the metal substrate to be plated through a dilute organic acid bath solution to remove contaminants and other deleterious materials, agitating the bath solution as the metal substrate passes therethrough, and thereafter electrolessly plating nickel on the surfaces of the metal substrate. The method of the present invention may be used to nickel plate substrates formed from steel, copper and aluminum.

14 Claims, No Drawings

METHOD FOR ELECTROLESS NICKEL PLATING OF METAL SUBSTRATES

This application is a continuation of application Ser. No. 08/761,849 filed on Dec. 9, 1996, now abandoned.

BACKGROUND OF THE INVENTION

The present invention relates to a method for forming a plating, particularly a nickel plating, on a metal substrate.

Most plating cycles known in the art involve multiple cleaning, rinsing and acid dipping steps prior to the actual plating step wherein the article to be plated is immersed into a plating bath. Earl C. Groshart in the METAL FINISHING GUIDEBOOK, 1994 Ed., pp. 166–170, published by *METAL FINISHING* magazine, notes that the article to be plated must be scrupulously cleaned to achieve any adhesion, but to achieve maximum adhesion, each base metal must be treated to a series of steps which remove all traces of foreign materials and which leave it active enough to form metallurgical bonds as well as physical ones. Groshart goes on to note the following steps for the plating of steel parts: pre-clean to remove gross contamination such as heavy oil or grease; rinse, if necessary; alkaline clean in a high pH soak cleaner for up to 30 minutes or in an anodic electrocleaner for 1 to 4 minutes; water rinse, possibly warm; water rinse; activate or pickle in a 5–10 wt % hydrochloric acid or 10 wt % sulfuric acid solution; water rinse, preferably warm; water rinse; immerse in plating bath; water rinse; hot water rinse; and dry.

If the steel being treated is carbon steel having more than 0.35% carbon, Groshart suggests that an anodic treatment in an electrocleaner or cyanide solution will be required prior to the immersion in the plating bath to remove the smut that is formed after the activation step. This is followed by a double rinse which adds three more steps to the aforementioned process. Steel plating would require a minimum of eleven dips and possibly as many as fourteen.

U.S. Pat. No. 2,266,330 to Nachtman shows a continuous tin plating line of 1940 vintage which did not have to contend with today's environmental regulations. In a preferred embodiment, the Nachtman process involved: (1) pickling to remove scale and oxides; (2) wet mechanically cleaning the strip to remove particles, film, etc., left by the pickling step; (3) plating with an under coat of metal; (4) rolling the strip to reduce it to proper gauge and thereby hardening it; (5) annealing the strip to remove the hardness produced in the previous step and to alloy the metal under coat to the base strip; (6) cleaning the annealed strip for further plating; (7) plating with a metal having a low melting point such as tin or an alloy such as terne; and (8) heating the strip to fuse the last applied coating and to alloy such coating with the metal under coating.

U.S. Pat. No. 4,257,853 to Quinton et al. illustrates a gold plating line that is more typical of the steps required today to gold plate strip. The metal plating apparatus includes a plurality of pre-plating stations comprising tanks or reservoirs containing various cleaning and rinsing solutions. A pulse plating or gold flash station including a plating tank is provided after the pre-plating stations and a plurality of post-plating stations or tanks are provided after the pulse-plating station.

U.S. Pat. No. 4,904,351 to Morin illustrates a nickel plating line for plating carbon filaments. The graphite fiber is electroplated by passing the fiber continuously through an electrolyte solution in a tank. Current is delivered to the fiber at a contact immediately prior to the surface of the electrolyte in the tank. The voltage is maintained above 16 volts. The fiber is kept cool enough outside the bath to prevent degradation by recycling the electrolyte to bathe the fiber from the point of contact to the point of immersion into the electrolyte.

To electroless nickel plate aluminum or its alloys requires pre-plate processing that is even more involved. Richard Macary of Enthone, Inc., in an article "Better Plating of Electroless Nickel on Aluminum", *Products Finishing,* October, 1987, pp. 52–63, has suggested a seven step process while noting that adequate rinsing of aluminum is an essential part of every successful electroless nickel plating line which could add up to fourteen additional rinsing steps. The final rinsing before entering the electroless nickel plating bath is particularly critical as it is well known that zinc cations carried over into the plating solution will act as a catalyst poison slowing the plating rate or even stopping plating completely.

Today, there is a demand for nickel plating metallic screening or metal strip made of mild steel and other alloys. Presently strip or screening that is web plated with nickel utilizes a plating line that is almost 500 feet long and that employs electroplating. The major disadvantages associated with the processing of this material are that electrolytic processing does not plate uniformly and that the deposit is heavier on the top and bottom of the web than it is on the sides or the interstices. Because of the non-uniformity of the deposit, it is necessary to apply a much heavier deposit than would otherwise be necessary to achieve adequate corrosion resistance. This is not only expensive, but the heavier deposits degrade the flexibility of the mesh.

SUMMARY OF THE INVENTION

Accordingly, it is an object of the present invention to provide an improved method for electroless plating of a metal substrate material.

It is a further object of the present invention to provide a method as above which has particular utility in the plating of nickel on a metal substrate.

It is a further object of the present invention to provide a method as above which results in a more uniform deposit of the coating material on the metal substrate.

It is yet another object of the present invention to provide a method as above which is easier to perform and economically and environmentally beneficial.

The foregoing objects are attained by the method of the present invention which broadly comprises the steps of: providing a metal substrate; treating the metal substrate by passing it through a dilute organic acid solution to remove contaminants and deleterious materials from surfaces of the metal substrate; agitating said organic acid solution as said metal substrate passes therethrough, preferably ultrasonically; and thereafter electrolessly plating the metal substrate with a metallic coating material. In a preferred embodiment of the present invention, the dilute organic acid solution comprises a bath solution containing less than about 12 wt % oxalic acid and a non-ionic fluorocarbon surfactant. When the base material for the substrate being plated is formed from copper or aluminum alloys, the metal substrate is passed through an aqueous bath containing at least about 5 PPM palladium cations prior to the electroless plating step.

The method of the present invention has been found to have particular utility in forming a nickel plating or coating on a steel, copper, or aluminum substrate. When forming the nickel plating, the substrate material is preferably passed through a bath containing nickel sulfate, hydroxyacetic acid, sodium hypophosphite, succinic acid, citric acid, ammonium hydroxide, lead and thiourea.

Other details of the method of the present invention, as well as other objects and advantages attendant thereto, will become clearer from the following detailed description.

DETAILED DESCRIPTION OF THE PREFERRED EMBODIMENT(S)

As previously discussed, the present invention relates to a method for continuously forming a nickel coating on a metal substrate. It should be recognized that the metal substrate to be coated by the method of the present invention can have any desired form. For example, it can be in sheet, strip, wire, or mesh form. The metal substrate may also comprise an individual article. The method of the present invention may be used to form a nickel coating on a mesh or web formed from a mild steel. The method of the present invention also has utility in forming a nickel plating on copper and aluminum substrates.

When plating a steel substrate, the method of the present invention has two principal steps. The first is to treat the metal substrate to be coated so as to remove unwanted contaminants, lubricants and other deleterious materials from surfaces of the substrate, while the second is an electroless plating step.

During the first step, the metal substrate is immersed in a dilute organic acid bath solution. In one embodiment of the present invention, the organic acid bath solution is an aqueous solution which contains oxalic acid in an amount up to its solubility limit, approximately 120 g/L at 24° C., preferably from about 2 wt % to about 12 wt % and most preferably in an amount less than 10 wt % such as 5 wt %. The bath also contains a non-ionic fluorocarbon surfactant such as FC-171 manufactured by 3M Co., in a concentration up to its solubility limit, approximately 1000 PPM. It is preferred however to keep the non-ionic fluorocarbon surfactant as low as possible to minimize any effect of drag over the plating bath. A preferred concentration is in the range of from about 24 PPM to about 300 PPM and a most preferred concentration is about 50 PPM. A useful acid/cleaner bath comprises an aqueous solution having 2.0 to 12.0 g/L oxalic acid dihydrate and 24–300 PPM FC-171.

The dilute organic acid bath solution is preferably maintained at a temperature in the range of from about 20 to about 40° C. The metal substrate is preferably passed through the bath solution at a rate sufficient to keep it resident in the bath solution for a time period in the range of from about 15 to about 60 seconds.

It has been found to be extremely useful to agitate the dilute bath solution during the treatment step to facilitate removal of contaminants and other deleterious materials from the surfaces of the metal substrate. Any suitable agitation means known in the art, such as a mechanical agitation device or an air sparger, may be used. Preferably the agitation is preformed ultrasonically at a frequency of from about 20 to about 45 kHz. Hereagain, any suitable means known in the art may be used to apply the ultrasonic agitation to the bath solution.

Prior to entering the acid/cleaner bath, the metal substrate may be immersed in a mild alkaline cleaner, if necessary and spray rinsed with de-ionized water.

After the metal substrate exits the acid/cleaner bath solution, it may be spray rinsed using recirculated de-ionized water. Thereafter, the cleaned metal substrate is subjected to an electroless nickel plating treatment.

In a preferred embodiment of the present invention, the metal substrate to be nickel plated is passed through a bath having a pH of from about 4.0 to about 6.0 at room temperature. The bath may have the following nominal composition: 20.0 grams/liter of nickel sulfate, hexahydrate; 10.0 ml/liter of hydroxyacetic acid (70%); 20.0 grams/liter of sodium hypophosphite, monohydrate; 5.0 grams/liter succinic acid; 10.0 grams/liter citric acid, monohydrate, optionally 60.0 ml/liter of ammonium hydroxide (28–30%, sp. gr. 0.9); 1–3 PPM lead in the final bath; and 1–3 PPM thiourea in the final bath. The hydroxyacetic acid is present in the bath as a complexing agent and is maintained at 100 to 150% of the nominal value. The nickel sulfate and sodium hypophosphite are maintained in the range of 90 to 100% of the above nominal value. All other components are usually maintained in the range of 75% to 100% of the nominal value. Citric acid is also present as a complexing agent. The succinic acid is present as a plating rate promoter.

The electroless nickel plating solution is preferably maintained at a temperature in the range of from about 85° to about 95° C. The metal substrate is preferably passed through the plating solution at a speed which keeps it resident in the solution for a time period of from about 2 to about 8 minutes.

After the nickel plated metal substrate exits the plating bath, it may be subjected to a two step rinsing operation. In the first rinsing step, the nickel plated metal substrate is spray rinsed using recirculating de-ionized water. In the second rinsing step, the nickel plated metal substrate is spray rinsed using recirculated de-ionized water at a temperature in the range of from about 70° to about 95° C. After rinsing, the nickel plated metal substrate is dried using hot air. Any suitable means known in the art may be used to dry the nickel plated metal substrate.

When the metal substrate being plated is formed from copper or aluminum alloys, the substrate is passed through a palladium bath and rinsed prior to entering the nickel plating bath. For aluminum and aluminum alloys, the palladium bath solution contains from about 0.5 to 5.0% by wt. hydrochloric acid, about 40–45 PPM palladium and the balance water. For copper and copper alloys, the palladium bath solution contains from about 0.5 to 5.0% by wt. hydrochloric acid, from about 5 to 300 PPM, preferably about 10 PPM, palladium and the balance water. The palladium cations are provided in an amount so that enough palladium is provided on the surface of the metal substrate to catalyze the reduction of the nickel.

The method of the present invention is particularly advantageous in that it allows continuous operation and continuous nickel plating of the metal substrate. It also provides a simplified pre-treatment cycle for the metal substrate. Still further, the number of processing steps is reduced by the use of a unique acid pickle/cleaner that is compatible with the electroless nickel plating bath. Because of this compatibility, some of the multiple rinsing steps that might otherwise be required can be eliminated.

Where the metal substrate to be coated is grossly contaminated, such as with heavy oil or grease, it may be subjected to a pre-treatment prior to immersion in the dilute organic acid cleaning bath. Any suitable pre-treatment known in the art may be used to remove the gross contamination from the surfaces of the metal substrate.

While it is preferred to ultrasonically agitate the dilute mineral acid cleaning bath solution, it is possible to mechanically agitate the solution. The principal advantage to mechanical agitation is economic—namely, mechanical agitation is less expensive to perform than ultrasonic agitation.

While the method of the present invention has been discussed in the context of a continuous plating operation, it should be recognized that it could also be used to nickel plate individual parts.

While it is preferred to use an organic acid both solution containing oxalic acid and a non-ionic fluorocarbon surfactant, there are alternative baths that will work with concentrations in the range of 0.025 to 1.0M with the lower concentrations best to minimize the possibility of any effect on the subsequent electroless nickel plating bath. Some organic acids that work are citric acid, succinic acid, malonic acid, malic acid, hydroxyacetic acid, tartaric acid, lactic acid, and acetic acid. It is believed that the dibasic or tribasic acids are better than the monobasic acid. Similarly, there are other fluorocarbon surfactants beside FC-171 that will work. Additionally anionic fluorocarbon surfactants may be used. When these other surfactants are used, they should be used in a concentration less than about 300 PPM.

While a preferred electroless nickel plating bath has been illustrated hereinbefore, there are alternative baths that may be used. The following illustrates some of these alternative baths including the preferred pH and temperature ranges:

| | |
|---|---|
| A. Lactic Acid Bath | |
| Nickel sulfate, hexahydrate | 20 g/L |
| Sodium hypophosphite, monohydrate | 20 g/L |
| Hydroxyacetic acid (70%) | 10 ml/L |
| Lactic Acid (85%) | 10 ml/L |
| Lead | 1–3 PPM |
| Thiourea | 1–3 PPM |
| pH | 4.4–4.8 |
| Temperature °C. | 85–95 |
| B. Fluoride Bath | |
| Nickel sulfate, hexahydrate | 30.0 g/L |
| Sodium hypophosphite, monohydrate | 30.0 g/L |
| Ammonium Bifluoride | 12.5 g/L |
| Hydroxyacetic acid (70%) | 50.0 ml/L |
| Ammonium Hydroxide (approx. 29%) | as required to adjust pH |
| Lead | 1–3 PPM |
| Thiourea | 1–3 PPM |
| pH | 4.8–6.5 |
| Temperature °C. | 85–95 |
| C. Simplified Standard Bath | |
| Nickel sulfate, hexahydrate | 20.0 g/L |
| Sodium hypophosphite, monohydrate | 20.0 g/L |
| Hydroxyacetic acid (70%) | 15.0 ml/L |
| Succinic acid | 5.0 g/L |
| Lead | 1–3 PPM |
| Thiourea | 1–3 PPM |
| pH | 4.8–6.5 |
| Temperature °C. | 85–95 |
| D. Alkaline Bath | |
| Nickel Chloride, hexahydrate | 20.0 g/L |
| Sodium pyrophosphate | 20.0 g/L |
| Sodium Fluoride | 5.0 g/L |
| Sodium hypophosphite, monohydrate | 40.0 g/L |
| Ammonium hydroxide (approx. 29%) | approx. 60 ml. to adjust pH |
| pH nominal | 8.2–8.4 |
| Temperature °C. | 80–85 |

It is apparent that there has been provided in accordance with this invention a method for electroless nickel plating of metal substrates which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method for providing a nickel coating on a substrate, the method comprising the steps of:

providing a substrate formed from a material selected from the group consisting of metals and metal alloys;

providing an organic acid solution comprising an organic acid, a surfactant and water, wherein the surfactant is selected from the group consisting of non-ionic fluorocarbon surfactants and anionic fluorocarbon surfactants;

agitating the organic acid solution to provide an agitated organic acid solution;

immersing the substrate in the agitated organic acid solution;

providing an electroless plating solution containing nickel; and immersing the substrate in the electroless plating solution so as to deposit nickel on the substrate.

2. The method of claim 1, wherein the metals are further selected from the group consisting of aluminum, copper, and iron and wherein the metal alloys are selected from the group consisting of aluminum alloys, copper alloys and iron alloys.

3. The method of claim 1, wherein the organic acid in the organic acid solution is selected from the group consisting of malonic acid, malic acid, hydroxyacetic acid, tartaric acid, lactic acid, oxalic acid and acetic acid.

4. The method of claim 1, wherein the agitation provided by the agitating step is accomplished by an ultrasonic means.

5. The method of claim 1, wherein the organic acid in the organic acid solution comprises approximately 2 to 12 weight percent oxalic acid, and the surfactant in the organic acid solution comprises 24 to 300 parts per million of a non-ionic fluorocarbon surfactant.

6. The method of claim 1, wherein the organic acid in the organic acid solution comprises less than approximately 10 weight percent oxalic acid and the surfactant in the organic acid solution comprises less than approximately 50 parts per million of a non-ionic fluorocarbon surfactant.

7. A method for providing a metallic coating on a substrate, the method comprising the steps of:

providing a substrate formed from a material selected from the group consisting of metals and metal alloys;

providing an alkaline cleaner solution;

immersing the substrate in the alkaline cleaner solution;

providing an organic acid bath solution comprising an organic acid, a surfactant and water, wherein the surfactant is selected from the group consisting of non-ionic fluorocarbon surfactants and anionic fluorocarbon surfactants;

agitating the organic acid bath solution to provide an agitated organic acid bath solution;

immersing the substrate in the agitated organic acid bath solution;

providing a palladium solution comprising palladium, acid and water;

immersing the substrate in the palladium solution;

providing an electroless plating solution containing nickel; and immersing the substrate in the electroless plating solution so as to deposit nickel on the substrate.

8. The method of claim 7, wherein the metals are further selected from the group consisting of aluminum, copper, and iron and wherein the metal alloys are selected from the group consisting of aluminum alloys, copper alloys and iron alloys.

9. The method of claim 7, wherein the organic acid in the organic acid solution is selected from the group consisting of malonic acid, malic acid, hydroxyacetic acid, tartaric acid, lactic acid, oxalic acid and acetic acid.

10. The method of claim 7, wherein the agitation provided by the agitating step is accomplished by an ultrasonic means.

11. The method of claim 7, wherein the organic acid in the organic acid solution comprises approximately 2 to 12 weight percent oxalic acid, and the surfactant in the organic acid solution comprises 24 to 300 parts per million of a non-ionic fluorocarbon surfactant.

12. The method of claim 7, wherein the organic acid in the organic acid solution comprises less than approximately 10 weight percent oxalic acid and the surfactant in the organic acid solution comprises less than approximately 50 parts per million of a non-ionic fluorocarbon surfactant.

13. The method of claim 7, wherein the metal forming the substrate is aluminum and the metal alloy forming the substrate is an aluminum alloy, wherein the acid in the palladium solution is hydrochloric acid in the range of approximately 0.5 to 5.0 weight percent and wherein the concentration of palladium in the palladium solution is approximately 5 to 300 parts per million.

14. The method of claim 7, wherein the metal forming the substrate is copper and the metal alloy forming the substrate is a copper alloy, wherein the acid in the palladium solution is hydrochloric acid in the range of approximately 0.5 to 5.0 weight percent and wherein the concentration of palladium in the palladium solution is is approximately 5 to 300 parts per million.

* * * * *